US005296001A

United States Patent [19]

Scherer

[11] Patent Number: 5,296,001

[45] Date of Patent: Mar. 22, 1994

[54] PROCESS FOR SEPARATING SILICIC COMPOUNDS FROM CLEANING BATHS AND PLANT FOR ITS APPLICATION

[75] Inventor: Lothaire W. Scherer, Pos-sur-Mer, France

[73] Assignee: Sollac, Puteaux, France

[21] Appl. No.: 29,913

[22] Filed: Mar. 11, 1993

Related U.S. Application Data

[63] Continuation of Ser. No. 713,364, Jun. 13, 1991, abandoned.

[30] Foreign Application Priority Data

Jun. 15, 1990 [FR] France ..... 90 07519

[51] Int. Cl.[5] ..... B01D 9/02

[52] U.S. Cl. ..... 23/295 R; 134/41; 210/803; 423/349; 423/DIG. 1

[58] Field of Search ..... 23/295 R; 134/41; 156/642; 210/781, 803; 423/349, DIG. 1

[56] References Cited

U.S. PATENT DOCUMENTS

| | | | |
|---|---|---|---|
| 4,184,955 | 1/1980 | Arvanitakis | 210/83 |
| 4,614,598 | 9/1986 | Zettier et al. | 210/781 |
| 4,636,317 | 1/1987 | Lewis | 210/748 |
| 4,889,697 | 12/1989 | Fukushima et al. | 423/140 |
| 5,032,369 | 7/1991 | Kondo et al. | 423/339 |

FOREIGN PATENT DOCUMENTS

| | | | |
|---|---|---|---|
| 1432661 | 2/1966 | France . | |
| 59-169902 | 9/1984 | Japan . | |
| 63-144123 | 6/1988 | Japan | 423/DIG. 1 |

OTHER PUBLICATIONS

Hidenobu Kondo, "Method for Removing Silicon Content in Hydrochloric Acid Pickled Waste Liquid . . . ", Patent Abstract of Japan, Oct. 1988 vol. 12, No. 405.

Hidenobu Kondo, "Removal of Silicon Component from Hydrochloric Acid Pickling Waste Liquid of Steel Material . . . " Patent Abstract of Japan, Feb. 1989, vol. 13, No. 49.

Yasutaka Tejima, "Process for Preparation of Iron Oxide from Hydrochloric Acid Pickling Waste Solution . . . " Patent Abstract of Japan, Oct. 1984, vol. 8, No. 225.

*Primary Examiner*—Gary P. Straub
*Assistant Examiner*—Timothy C. Vanoy
*Attorney, Agent, or Firm*—Cushman, Darby & Cushman

[57] ABSTRACT

The subject of the invention is a process for separating silicic compounds from baths for cleaning steel substrates containing iron ions and silicic compounds, consisting of the following stages:

a) a concentrated spent cleaning bath is cooled in a controlled manner to a temperature below 60° C. so as to precipitate the silicic compounds, b) the cleaning bath is allowed to cool for at least 2 hours, c) the cleaning bath is reheated, d) the silicic compounds precipitated from the cleaning bath are separated off.

6 Claims, 1 Drawing Sheet

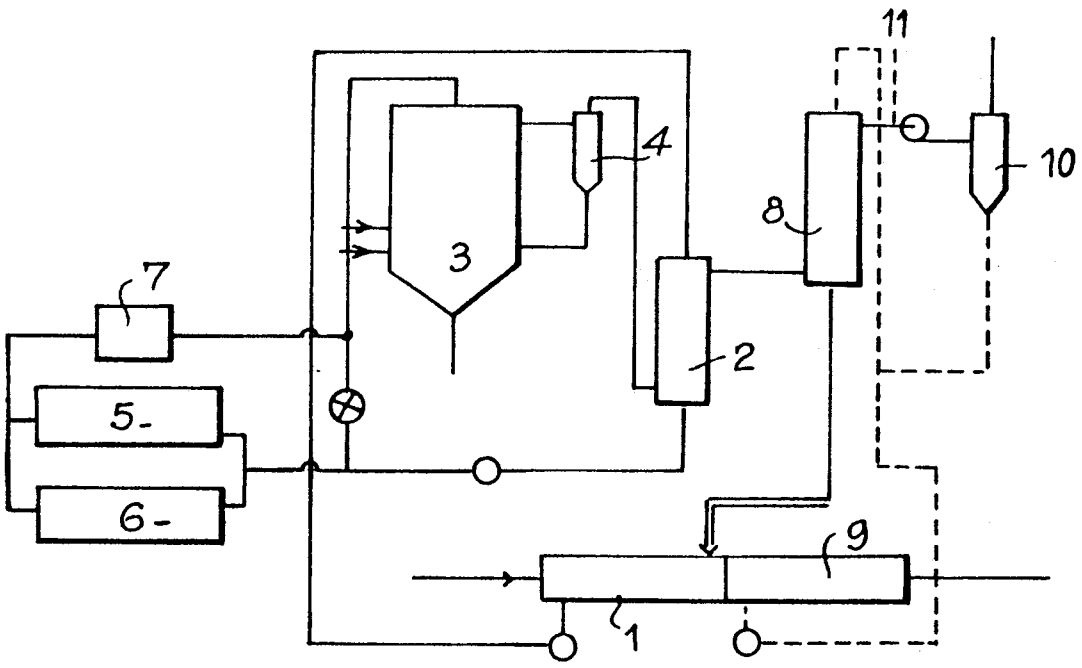
10
11
8
2
4
3
9
1
7
5-
6-

PROCESS FOR SEPARATING SILICIC COMPOUNDS FROM CLEANING BATHS AND PLANT FOR ITS APPLICATION

This is a continuation of application Ser. No. 07/713,364, filed on Jun. 13, 1991, which was abandoned upon the filing hereof.

The present invention relates to a process for separating silicic compounds from cleaning or scouring baths containing iron ions and silicic compounds, and to a device for applying the process.

BACKGROUND OF THE INVENTION

A process for separating a silicic compound from a spent steel-cleaning bath is known from application Ser. No. EP-0,141,034.

In this process the spent cleaning bath passes through a filter consisting of a material adsorbing the silicic compound.

Such a process has the disadvantage of requiring an operation of regeneration of the adsorbent materials forming the filter. In fact, in the course of its use, the adsorbent filter becomes blocked and the flow rate and the volume of the treated cleaning bath decreases progressively.

The cleaning baths currently employed for cleaning steel substrates contain iron ions, essentially in the form of ferrous ions, and a certain proportion of silicic compounds formed from the element silicon originating from the substrate.

After having been concentrated beforehand, these cleaning baths are decomposed thermally by known methods and are, in particular, calcined in an oven of the Ruthner type, and this makes it possible to recover iron oxides, essentially in the $Fe_2O_3$ form.

The iron oxides, being sufficiently pure, can be employed as colorants, for example in paints and cosmetic products, or as excipients in the pharmaceutical industry. They also form part of the manufacture of magnetic components or of the manufacture of cements, to improve the mechanical characteristics.

The silica content of the iron oxides currently recovered from cleaning baths is at least 350 ppm, whereas it would be desirable to lower it below 100 ppm for the applications referred to above.

SUMMARY OF THE INVENTION

The objective of the present invention is to propose a process making it possible to increase the purity of the iron oxides while lowering their content of residual silicic compounds.

The subject of the invention is thus a process for separating silicic compounds from baths for cleaning steel substrates containing iron ions and silicon compounds, consisting of the following stages:

a) a concentrated spent cleaning bath is cooled in a controlled manner to a temperature below or equal to 60° C. so as to precipitate the silicon compounds, b) the cleaning bath is allowed to cool for at least 2 hours, c) the cleaning bath is reheated, d) the silicon compounds precipitated from the cleaning bath are separated off.

The other advantageous characteristics of the invention are:

the controlled cooling rate is between 0.2 and 4° C./min and is preferably approximately 2° C./min, the cooling temperature of the cleaning bath is preferably between 20° and 40° C., the cleaning bath is reheated to a temperature of approximately 80° C., the precipitated silicic compounds are separated from the cleaning bath by any appropriate means, especially by settling, centrifuging and/or filtration. In the case of a filtration, the latter is advantageously carried out on filters which have a porosity of less than or equal to 20 μm.

A further subject of the invention is a plant comprising means for regenerating the cleaning bath containing iron ions and silicic compounds, characterised in that the regenerating means additionally comprise at least one tank for controlled cooling of the cleaning bath and for reheating the latter and at least one device for separating off the silicic compound(s) precipitated from the cleaning bath, the separating device advantageously consisting of a centrifuging device and/or a filtration device comprising filters with a porosity of less than or equal to 20 μm.

BRIEF DESCRIPTION OF THE DRAWING

The process and the plant of the invention are described in greater detail below with reference to FIG. 1 which shows a diagram of a plant for cleaning steel sheets.

DESCRIPTION OF THE PREFERRED EMBODIMENT

The plant comprises a cleaning unit 1 at the exit of which the cleaning bath containing water, hydrochloric acid, iron chlorides and one or more silicic compounds is depleted in acid and enriched in iron. The temperature of the bath is approximately 90° C.; it contains from 30 to 60 g/l of hydrochloric acid and 90 to 140 g/l of iron ions and possibly a compound preventing the etching of the substrate. The spent cleaning bath is then directed towards an evaporator 2 to be concentrated therein. The evaporator 2 consists of a liquid-gas exchanger fed with hot gases leaving a thermal device 3 via a cyclone 4.

The evaporator 2 makes it possible to preheat the bath while concentrating it by evaporating the water present in the latter.

The concentrated spent bath recovered at the exit of the evaporator 2 is directed towards cooling and reheating tanks 5 and 6, where it is cooled to a temperature equal to or lower than 60° C., preferably at a cooling rate of approximately 2° C./min. The cleaning bath is then allowed to cool for a period of at least 2 hours, and this makes it possible to create favourable conditions for the silicic compounds to crystallise in the form of relatively large particles.

The bath is then reheated so that the dissolving, particularly of iron chloride, may be sufficient and to obtain a bath viscosity permitting a separation of the silicic compound(s), for example by filtration.

The reheating rate is not a determinant and may vary from a few minutes to a few hours.

On leaving the cooling and reheating tanks 5 and 6 the cleaning bath is advantageously centrifuged and/or filtered in the automatic centrifuging and/or filtration unit 7, and this makes it possible to collect the precipitated and unredissolved silicic compound(s).

The cleaning bath depleted in silicic compounds is then directed towards the top part of the thermal device 3, where it is treated to obtain the iron oxide. The iron oxide is collected at the base of the thermal device 3.

In the known thermal device 3, for example for the application of the Ruthner process, the steam and acid vapour produced, containing a residual quantity of iron oxide, are sent to a cyclone 4 which separates off the iron oxide. The residual iron oxide thus separated is reintroduced into the thermal device 3.

The hot gases removed at the head of the cyclone 4 are employed for operating the evaporator 2.

On leaving the evaporator 2, the hot gases comprising essentially steam and hydrochloric acid flow into an absorber 8 fed with water in its upper part using water originating from the rinsing unit 9 used for rinsing the substrates which leave the cleaning unit 1.

The acid-depleted vapours leaving the upper part of the absorber 8 are directed towards a fume-scrubbing device 10 fed with water via a water top-up 11. The fume-scrubbing water is added to the water feeding the absorber 8 from the rinsing unit 9.

At the lower part of the absorber 8 a regenerated bath containing a solution of hydrochloric acid is collected and can be employed once again for a second cleaning and regenerating cycle.

Given below are the results of tests carried out on a number of cleaning baths using the process according to the invention, which consisted in cooling the cleaning baths containing iron ions and silicic compounds from the temperature of approximately 80° C. to a temperature of approximately 40° C. at a cooling rate of approximately 2° C./min, allowing the cleaning baths to cool for a period of approximately 3 hours, reheating the baths to 80° C. and then separating off the silicic compound(s) precipitated from the cleaning baths by filtration on filters of variable porosity.

The efficiency of the process of the invention is checked by determining silicon or silica by the following methods:

gravimetric method for measuring the quantity of silica retained by the filters atomic absorption method for measuring the quantity of silicon present in the filtrate by ICP (inductive coupling plasma) to measure the quantity of silicon in the iron oxides obtained by evaporation of the cleaning bath.

The results obtained, expressed as silica content, are summarised in the table below:

| Type of baths | Cooling temp. of the baths | Stabilisation time | Filter porosity (μm) | Si expressed as $SiO_2$ separated on the filter (mg/ml) | remaining in the bath (mg/ml) | remaining in the iron oxide (ppm) |
|---|---|---|---|---|---|---|
| Spent concentrated | <40° C. | +3 h | 2 | not determined | <4* | 70 |
| | | | 5 | not determined | <4 | 75 |
| | | | 8 | 108 | <4 | 100 |
| | | | 10 | not determined | <4 | 80 |
| | | | 16 | 112 | <4 | 80 |
| | | | 20 | 106 | <4 | 80 |

*limit of detection of the measuring device.

The process and the device according to the invention for the substantial removal of the silicic compounds from the cleaning baths can be easily adapted to an industrial environment and make it possible to obtain iron oxide whose silica content is lower than 100 ppm.

I claim:

1. Process for separating silicic compounds from baths for cleaning steel substrates containing iron ions and silicic compounds, consisting of the following stages:

a) a concentrated spent cleaning bath is cooled in a controlled manner, at a rate of between 0.2 and 4° C./min, to a temperature below 60° C. so as to precipitate the silicic compounds, b) terminating the controlled cooling of step (a) and allowing crystallization of silicic compounds to proceed in the cleaning bath for at least 2 hours, c) the cleaning bath is reheated to obtain a bath viscosity permitting a separation of the silicic compounds, d) the silicic compounds precipitated from the cleaning bath are separated off.

2. Process according to claim 1, characterised in that the rate of cooling is approximately 2° C./min.

3. Process according to claim 1, characterised in that the concentrated spent cleaning bath is cooled in a controlled manner to a temperature of between 20° and 40° C.

4. Process according to claim 1, characterised in that the reheating temperature is approximately 80° C.

5. Process according to claim 1, characterised in that the precipitated silicic compounds are separated from the cleaning bath by settling, centrifuging and/or filtration.

6. Process according to claim 5, characterised in that the precipitated silicic compounds are separated from the cleaning bath by filtration on filters which have a porosity of less than or equal to 20 μm.

* * * * *